US006038738A

United States Patent [19]

Neag et al.

[11] Patent Number: 6,038,738

[45] Date of Patent: Mar. 21, 2000

[54] HINGE ASSEMBLY

[75] Inventors: Dorinel Neag, Walled Lake; Stylianos A. Meidanis, West Bloomfield; Thomas R. Carbone, Grosse Pointe, all of Mich.

[73] Assignee: Chrysler Corporation, Auburn Hills, Mich.

[21] Appl. No.: 09/022,970

[22] Filed: Feb. 13, 1998

[51] Int. Cl.[7] ..... E05D 11/10

[52] U.S. Cl. ..... 16/324; 16/343; 16/371

[58] Field of Search ..... 16/324, 325, 326, 16/329, 330, 334, 343, 344, 371, 82, 85; 49/502; 296/146.1, 146.11

[56] References Cited

U.S. PATENT DOCUMENTS

| | | | |
|---|---|---|---|
| 1,116,714 | 11/1914 | Lang | 16/355 |
| 3,969,789 | 7/1976 | Wize | 16/145 X |
| 4,159,837 | 7/1979 | Morita | 292/127 X |
| 4,446,596 | 5/1984 | Arlauskas | 16/333 X |
| 4,472,857 | 9/1984 | Guionie et al. | 16/341 X |
| 4,532,675 | 8/1985 | Salazar | 16/335 |
| 4,655,499 | 4/1987 | Piper | 296/146 |
| 4,672,715 | 6/1987 | Beckwith | 16/334 |
| 4,719,665 | 1/1988 | Bell | 16/232 |
| 5,054,165 | 10/1991 | Marchione | 16/270 X |
| 5,142,739 | 9/1992 | Lin | 16/326 |
| 5,265,936 | 11/1993 | Droulon et al. | 297/361.1 X |
| 5,291,634 | 3/1994 | Zanetti | 16/333 X |
| 5,311,644 | 5/1994 | Laforgerie | 16/334 X |
| 5,561,887 | 10/1996 | Neag et al. | 16/334 |
| 5,611,114 | 3/1997 | Wood, Jr. et al. | 16/366 |
| 5,673,459 | 10/1997 | Baghdasarian | 16/308 X |
| 5,685,046 | 11/1997 | Neag et al. | 16/366 |
| 5,727,287 | 3/1998 | Hosken et al. | 16/82 X |
| 5,884,434 | 3/1999 | Dedrich et al. | 49/503 X |

*Primary Examiner*—Lynne H. Browne
*Assistant Examiner*—Brian H. Buck
*Attorney, Agent, or Firm*—James R. Yee

[57] ABSTRACT

A hinge assembly normally limits pivotal movement of a door within a first range and selectively permits pivotal movement of the door within a second, larger range. The hinge assembly includes a body hinge member fixedly attached to a frame and a door hinge member fixedly attached to the associated door. The body hinge member and the door hinge member are pivotally interconnected. The hinge assembly further includes a latch mechanism which normally limits pivotal movement of the door within the first range. Manual urging of the latch member to a release position selectively permits the door to be pivoted beyond the first range. The latching member is operable to automatically return to its latched position in response to closing of the door.

6 Claims, 5 Drawing Sheets

HINGE ASSEMBLY

BACKGROUND OF THE INVENTION

1. Technical Field

The present invention generally relates to hinges. More particularly, the present invention relates to a hinge assembly, specifically but not exclusively for a motor vehicle, operative for selectively limiting pivotal movement of an associated door.

2. Discussion

In a conventional manner, passenger doors of motor vehicles are pivotally mounted to the vehicle body for movement between an open position and a closed position. Various arrangements are known for positively locating the door relative to the vehicle body at a plurality of positions. In this regard, it is known in the art to provide a hinge assembly operative to establish an intermediate position between a fully open position and a closed position. When limited space laterally adjacent to a passenger door prohibits the door from fully opening, opening of the door to the intermediate position reduces incidents of unintentional damage to the door, to adjacent vehicles, or both.

One known arrangement for positively locating a vehicle door at a plurality of positions is disclosed in commonly assigned U.S. Pat. No. 5,685,046, which is entitled "Motor Vehicle Double Pivot Hinge". This patent discloses a double pivot hinge for moving a vehicle door between closed, intermediate and full open positions. A U-shaped link has a bight portion joining first and second legs, with body and door hinge leafs each pivoted by a pin to a respective first and second leg. The hinge features a cam plate, fixed on each leaf, defining an arcuate cam edge having its center on its associated pin axis, and a single locking bar, supporting a cam follower on one end and a lug follower on an opposite end. U.S. Pat. No. 5,685,046 is hereby incorporated by reference as if fully set forth herein.

While the arrangement shown and described in U.S. Pat. No. 5,685,046 and many other prior known arrangements have proven to be commercially acceptable for their intended applications, they are all associated with certain disadvantages. In this regard, known arrangements are typically operative for pivoting an associated vehicle door through approximately sixty (60) degrees to provide access to the passenger compartment. Occasionally, greater access to the passenger compartment is desirable. For example, physically impaired passengers often encounter difficulty entering and exiting a motor vehicle which could be alleviated through increased range of passenger door rotation. Such increased range of door rotation would also facilitate loading and unloading of oversized cargo. In known arrangements in which the associated vehicle door is permitted to pivot through an angle larger than sixty (60) degrees, a suitable mechanism for selectively limiting pivot door movement has not been incorporated.

SUMMARY OF THE INVENTION

It is a principal object of the present invention to provide a hinge assembly for a motor vehicle which selectively permits an associated vehicle door to pivot beyond a conventional operating range.

It is another object of the present invention to provide a hinge assembly including a latch member movable between a first position for allowing pivotal movement of an associated vehicle door within a first range and a second position for allowing pivotal movement of the associated vehicle door in a second, larger range.

In one form, the present invention provides a hinge assembly for pivotally attaching a door to a frame. The hinge assembly includes a body hinge member fixedly attached to the frame and a door hinge member fixedly attached to the door. The door hinge member is pivotally connected to the body hinge member. The hinge assembly further includes a latch mechanism operatively interconnected to the body hinge member and the door hinge member. The latch mechanism is operable to normally limit relative movement between the door hinge member and the body hinge member within a first range and selectively permit relative movement between the door hinge member and the body hinge member within a second, larger range.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
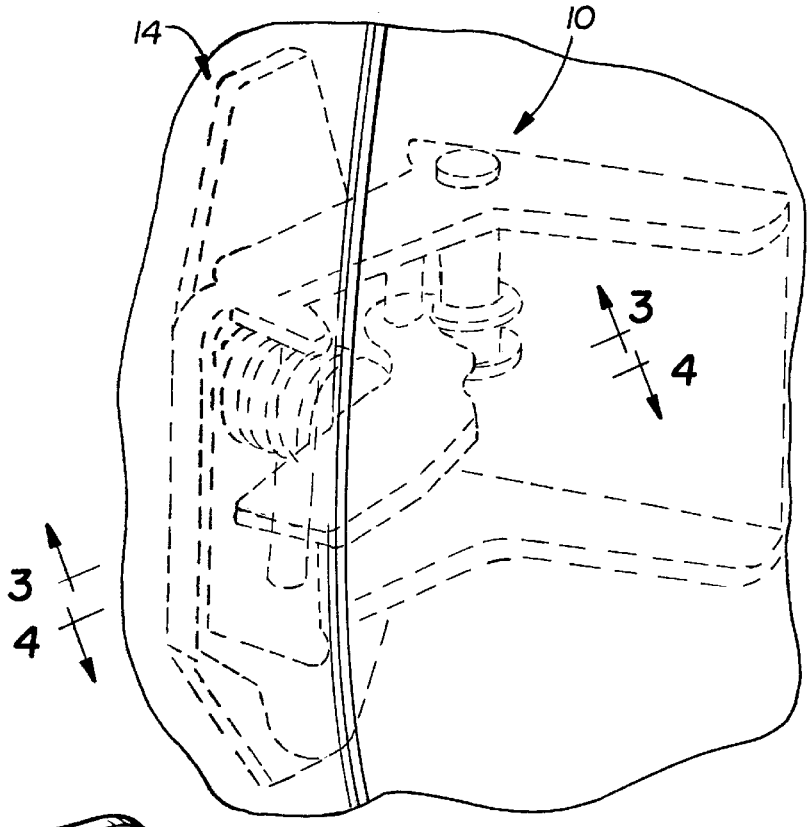
FIG. 1 is an environmental view of a portion of a motor vehicle incorporating a hinge assembly constructed in accordance with the teachings of a preferred embodiment of the present invention.

Turning generally to the drawings, a hinge assembly constructed in accordance with the teachings of a preferred embodiment of the present invention is identified with reference numeral 10. Throughout the drawings, the hinge assembly 10 is shown operatively interconnecting a frame 12 of a motor vehicle 14 with a passenger door 16. The passenger door shown is specifically a rear passenger door 16 pivotally interconnected to the vehicle B-pillar 12. However, it will be appreciated by those skilled in the art that the hinge assembly 10 of the present invention is equally suitable for a front passenger door 18 and other vehicle doors (e.g., tailgates, etc.), as well as non-automotive applications.

Figure 3:
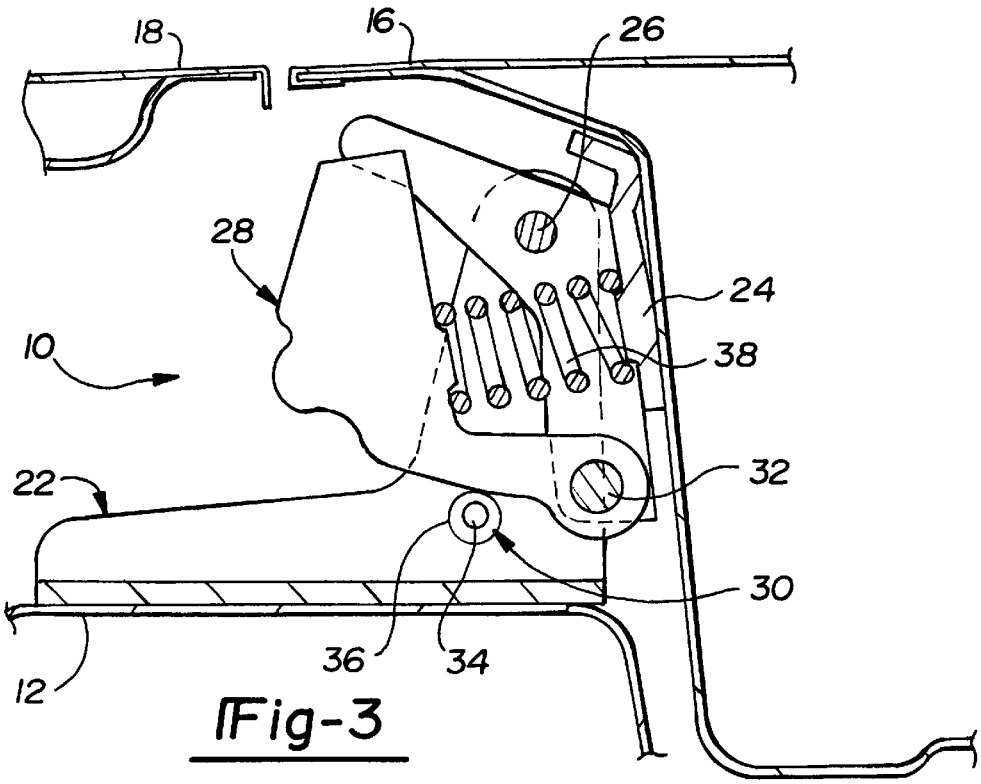
FIG. 3 is a cross-sectional view taken along the line 3—3 illustrating the hinge assembly when the door is in a closed position.
Figure 4:
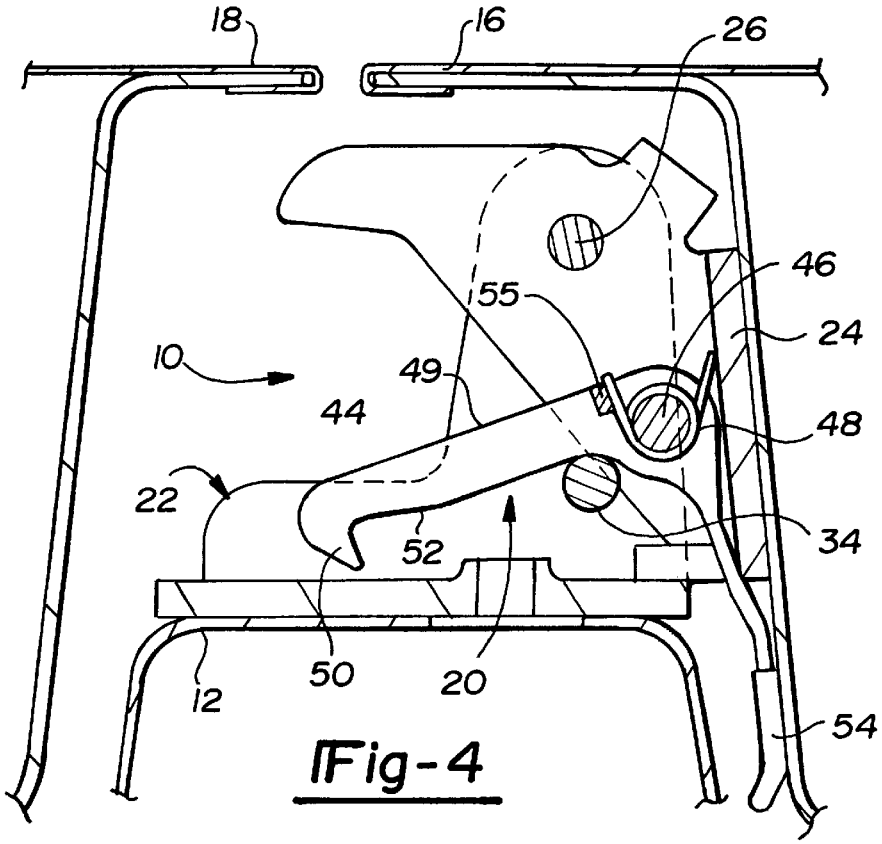
FIG. 4 is a cross-sectional view taken along the line 4—4 of FIG. 1 further illustrating the hinge assembly when the door is closed.
Figure 5:
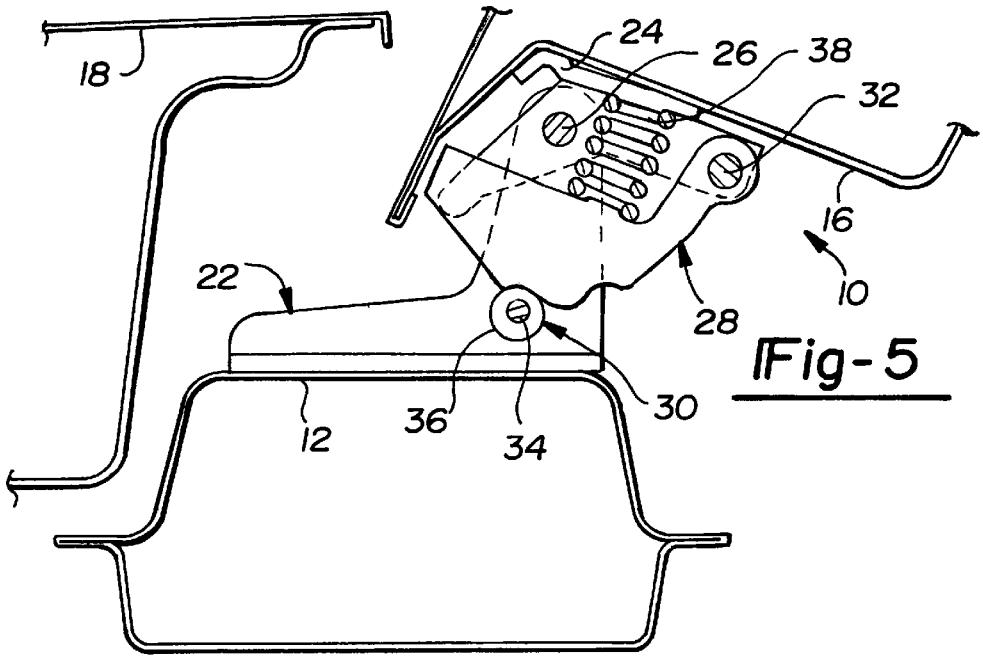
FIG. 5 is a cross-sectional view similar to FIG. 3 illustrating the hinge assembly in a door intermediate open position.

The primary focus of the present invention is directed to a latching arrangement 20 (shown most specifically in FIGS. 4, 6, and 8) which normally operates to limit relative movement of the door 16 relative to the frame 12 within a first range between a closed position (shown in FIGS. 3 and 4) and an open position (shown in FIGS. 5 and 6 and hereinafter referred to as an intermediate position). The latching arrangement 20 is selectively operable to permit movement of the door 16 relative to the frame 12 within a second, larger range between the closed position and a fully open position (shown in FIGS. 7 and 8). Prior to addressing the construction and operation of the latching arrangement 20 of the present invention, an understanding of the remaining components of the hinge assembly 10 is warranted.

Figure 2:
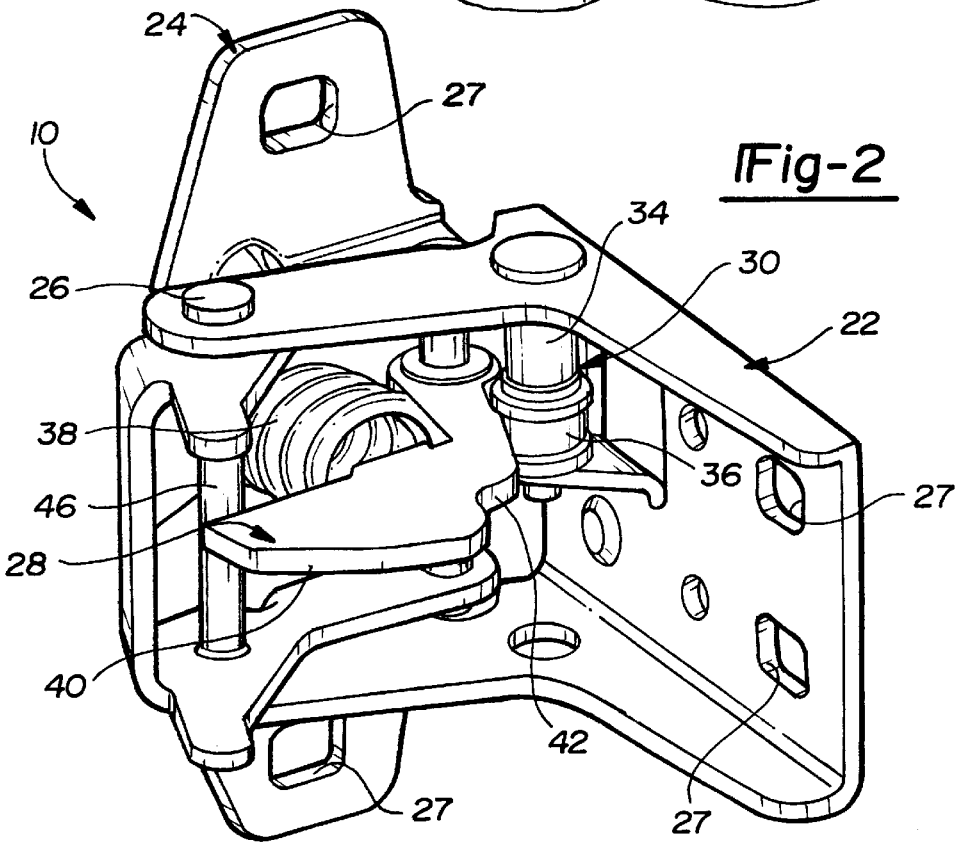
FIG. 2 is an enlarged perspective view of the hinge assembly of FIG. 1 shown removed from the motor vehicle for purposes of illustration.

The hinge assembly 10 includes a first hinge member or body hinge member 22 fixedly attached to the B-pillar 12. The hinge assembly 10 further includes a second hinge member, or door hinge member 24, fixedly attached to the passenger door. The first and second hinge members 22 and 24 are each provided with a plurality of apertures 27 (shown in FIG. 2) adapted to receive fasteners (not shown) for attachment to the frame 12 and the door 16, respectively, in a conventional manner. Alternatively, the members 22 and 24 may be welded or otherwise suitably attached. The first and second hinge members 22 and 24 are pivotally interconnected through a pair of hinge pins 26.

To provide means for positively locating the passenger door 16 relative to the frame 12, the hinge assembly 10 includes a camming plate 28 carried by the passenger door 16 and a cooperating cam follower 30 carried by the frame 12. More specifically, the camming plate 28 is pivotally interconnected to the door hinge member 24 through a pivot pin 32. The cam follower 30 is illustrated to include a pin 34 attached to the body hinge member 22 and a bushing 36. A coil spring 38 biases the camming plate 28 into engagement with the bushing 36 of the cam follower 30. As the passenger door 16 is rotated from its closed position, the coil spring 38 functions to maintain contact between a camming surface 40 of the camming plate 28 and the bushing 36. The camming surface 40 includes a pair of detents 42 for positively locating the door 16 between its closed position and its intermediate position.

Figure 6:
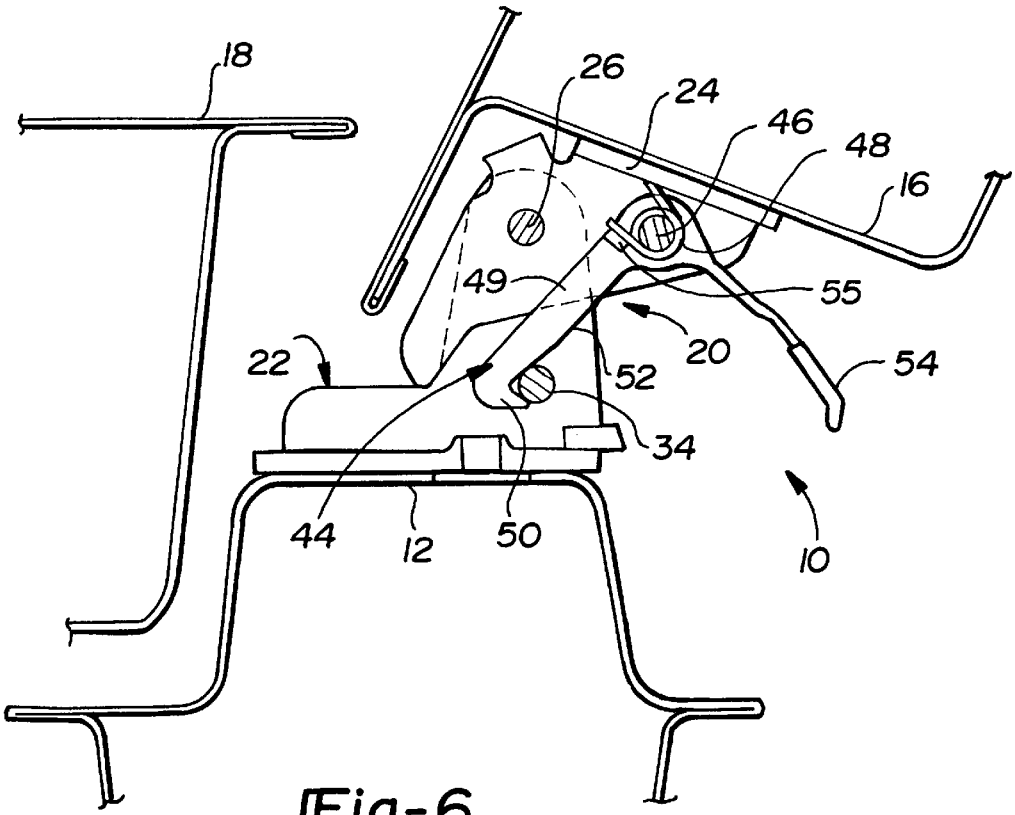
FIG. 6 is a cross-sectional view similar to FIG. 4 illustrating the hinge assembly of the present invention in the door intermediate open position.
Figure 7:
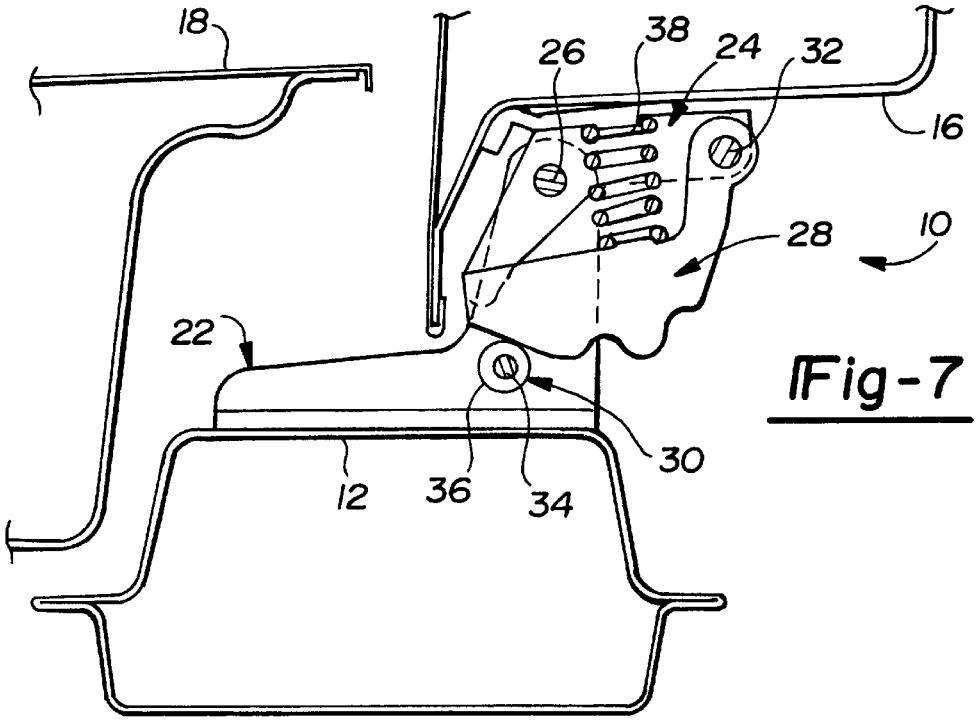
FIG. 7 is a cross-sectional view similar to FIG. 3 illustrating the hinge assembly in a door full open position.
Figure 8:
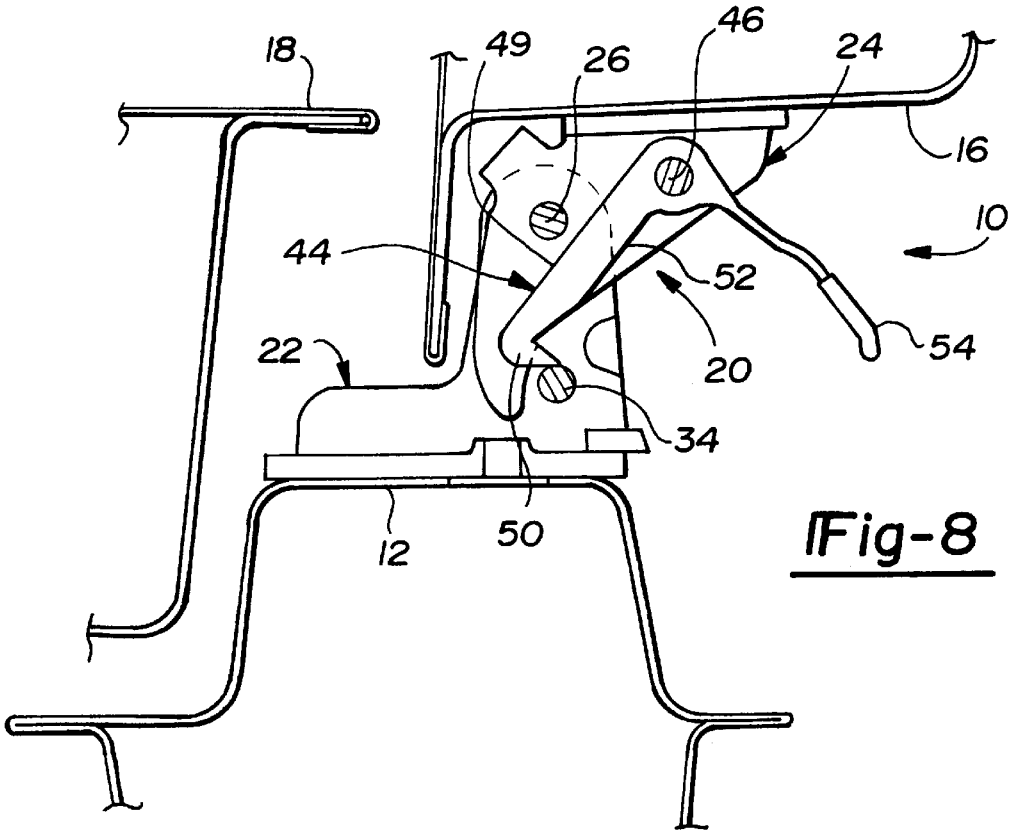
FIG. 8 is a cross-sectional view similar to FIG. 4 illustrating the hinge assembly of the present invention in the door full open position.
Figure 9:
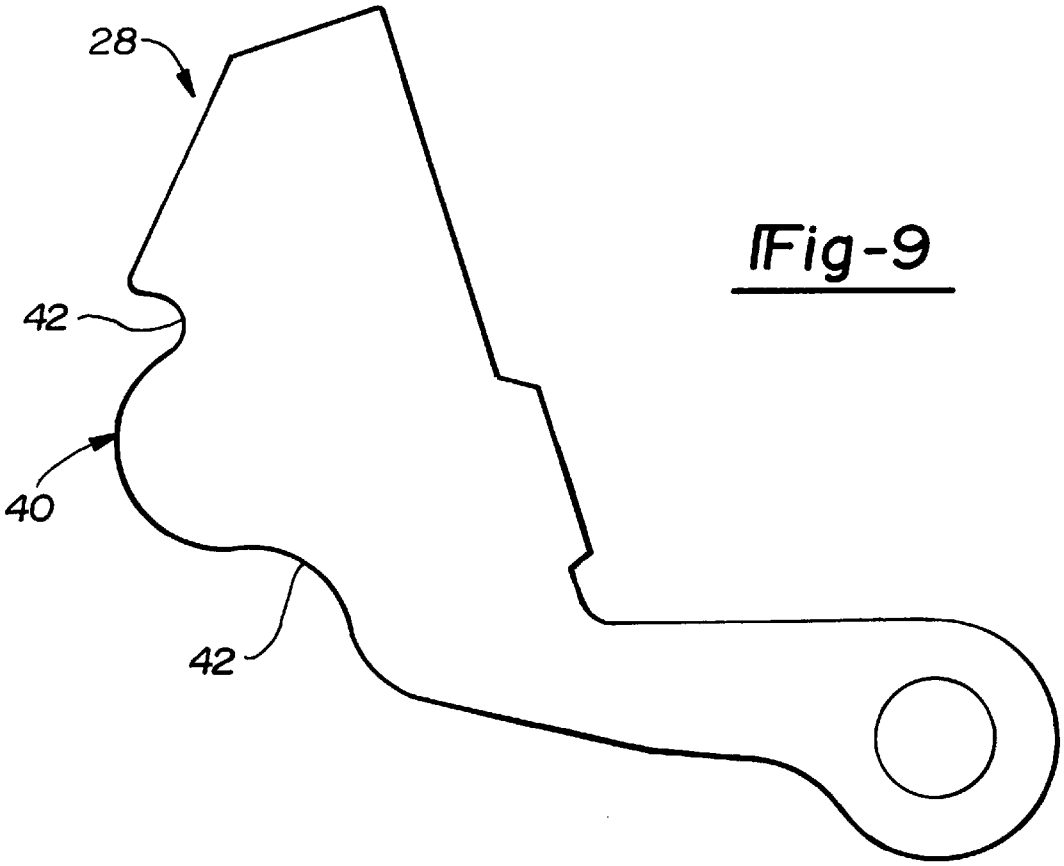
FIG. 9 is a view of the cam member of FIG. 2 removed from the hinge assembly for purposes of illustration.
Figure 10:
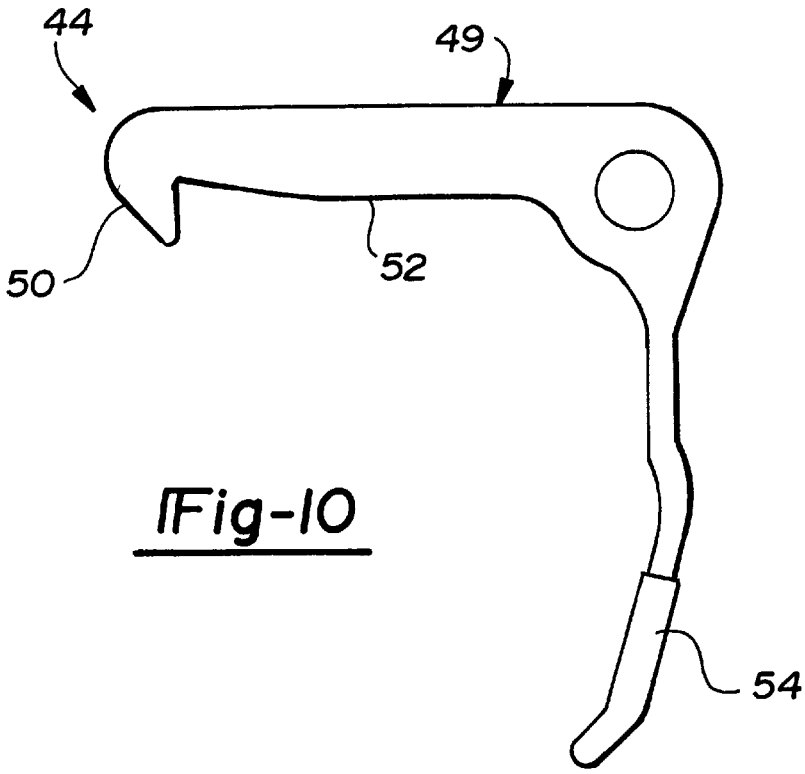
FIG. 10 is a view of the latch member of FIG. 2 removed from the hinge assembly for purposes of illustration.

The latching arrangement 20 is illustrated to preferably include a latching member movable between a latched position (e.g., as shown in FIG. 6) and a release position (e.g., as shown in FIG. 8) to selectively permit the door 16 to be rotated beyond the intermediate position to the fully opened position. In the preferred embodiment, the latch member 44 is pivotally interconnected to the second hinge member 24 through a pivot pin 46. A clock spring 48 surrounds the pivot pin 46 and normally biases the latch member 44 to its latched position.

The latch member includes an arm 49 which terminates in a hook portion 50 which normally engages the pin 34 when the door 16 is rotated to its intermediate position and thereby prevents further rotation. The force provided by the clock spring 48 biases a contact surface 52 of the arm 49 into an engagement with the pin 34. As the door is rotated from its closed position to its intermediate position, the pins travels along the surface 52 until it encounters the hook portion 50.

To provide means for manually rotating the latch member 44 to its released position, the hinge assembly 10 of the present invention includes a manually operated handle 54. When the door 16 is rotated to its intermediate position, the handle 54 is readily accessible between the door 16 and the B-pillar 12. Rotation of the handle 54 in a clockwise direction (as shown in FIGS. 4, 6 and 8), in turn rotates the arm 49 in a clockwise direction. As a result, the hook portion 50 is displaced from the pin 34, thereby permitting further rotation of the door 16 from its intermediate position to its fully opened position.

With specific reference to FIG. 8, when the door 16 is in its fully opened position and the handle 54 is released, the coil spring 38 forces a distal end of the arm 49 into engagement with the pin 34. By rotating the door 16 from its fully opened position to its intermediate position, the latch member 44 is automatically returned to its latched position under the biasing force of the clock spring 48. As a result, when the door 16 is subsequently closed and reopened, pivotal movement of the door will be limited within the first range between the closed position and the intermediate position unless the handle 54 is again manually actuated.

While the above description constitutes the preferred embodiment of the invention, it will be appreciated that the invention is susceptible to modification, variation, and change without departing from the proper scope or fair meaning of the accompanying claims. For example, it is anticipated that the latch member 44 could alternatively be moved between its latched and release positions in response to movement of an electrical switch.

We claim:

1. A hinge assembly for pivotally attaching a passenger door to a frame of a motor vehicle, the hinge assembly comprising:

first and second hinge members pivotally interconnected for relative rotation about a hinge axis, said first and second hinge members adapted to be attached to the door and the frame, respectively;

a camming member adapted to be pivotally connected to the door;

a cam follower adapted to be carried by the frame;

a first biasing member for biasing said camming member into engagement with said cam follower; and a manually operable latching mechanism connected to one of said first and second hinge members, said manually operable latching mechanism operable in a first mode in which a catch of said latching mechanism lockably engages a stop of the other of said first and second hinge members such that an amount the door may be pivoted relative to the frame is limited to a first range of motion, and operable in a second mode in which said catch lockably disengages said stop such that said amount the door may be pivoted relative to the frame increases to a second range of motion larger than the first range of motion.

2. The hinge assembly for pivotally attaching a door to a frame of a motor vehicle of claim 1, wherein said latching mechanism automatically returns to said first mode when the door is in a closed position.

3. The hinge assembly for pivotally attaching a door to a frame of a motor vehicle of claim 2, wherein said latching mechanism includes a latch member moveable between a first position and a second position and including said catch, such that said catch of said latch member locks onto said stop to prevent the door from rotating to a fully open position when in said first position and unlocks from said stop to allow the door to rotate to the fully open position when in said second position.

4. The hinge assembly for pivotally attaching a door to a frame of a motor vehicle of claim 3, wherein said latch member is connected to said second hinge member and includes said catch at a first end.

5. The hinge assembly for pivotally attaching a door to a frame of a motor vehicle of claim 3, wherein said latch member is pivotally moveable between said first and second positions.

6. The hinge assembly for pivotally attaching a door to a frame of a motor vehicle of claim 1, wherein said first range is approximately 60° and said second range is approximately 90°.

* * * * *